US005338019A

United States Patent [19]

Hill et al.

[11] Patent Number: 5,338,019

[45] Date of Patent: Aug. 16, 1994

[54] RECIPROCATING SHEET FEEDER APPARATUS FOR BOX BLANK FABRICATION EQUIPMENT HAVING AN ADJUSTABLE PUSHER ELEMENT

[75] Inventors: Alan M Hill, Topeka; William R. Meeks, Lawrence, both of Kans.

[73] Assignee: Lawrence Paper Company, Lawrence, Kans.

[21] Appl. No.: 992,554

[22] Filed: Dec. 18, 1992

Related U.S. Application Data

[62] Division of Ser. No. 924,625, Aug. 3, 1992, Pat. No. 5,246,222, which is a division of Ser. No. 835,534, Feb. 14, 1992, Pat. No. 5,181,899.

[51] Int. Cl.[5] ..... B65H 3/36

[52] U.S. Cl. ..... 271/139; 271/144; 74/421 R

[58] Field of Search ..... 271/139, 140, 144, 128, 271/131; 74/421 R

[56] References Cited

U.S. PATENT DOCUMENTS

| | | | |
|---|---|---|---|
| 910,557 | 1/1909 | Mann | 271/139 |
| 1,127,945 | 2/1915 | Tognini | 74/421 R |
| 3,804,402 | 4/1974 | Hoffendorf . | |
| 5,246,222 | 9/1993 | Hill et al. | 271/144 X |

FOREIGN PATENT DOCUMENTS

| | | | |
|---|---|---|---|
| 0476626 | 3/1992 | European Pat. Off. . | |
| 2403600 | 8/1974 | Fed. Rep. of Germany | 271/144 |
| 59-133143 | 7/1984 | Japan . | |
| 2145065 | 8/1983 | United Kingdom . | |

*Primary Examiner*—Robert P. Olszewski
*Assistant Examiner*—Boris Milef
*Attorney, Agent, or Firm*—Hovey, Williams, Timmons & Collins

[57] ABSTRACT

Box blank-forming apparatus (60) is provided which includes a feeder assembly (62) and a scoring/slotting assembly (64) each provided with adjustment structure (62*a*, 64*a*) to facilitate makeready adjustment of the apparatus (60) between production runs. The feeder assembly (62) preferably includes a reciprocal pusher element (170) operable to successively engage sheets (30) to be formed into box blanks (36). The element (170) is supported by a pair of elongated, threaded, axially rotatable, fore and aft translatable positioning screws (146, 148), so that upon rotation of the screws (146, 148), a reference position of the pusher element (170) may be varied. Adjustment of the assembly (64) is accomplished by means of compensators (292, 294) which are respectively coupled to associated slotter wheel and scoring wheel shafts (288, 286). Operation of the slotter wheel shaft compensator (294) serves to adjust the circumferential positions of the fixed slotter knives (358), whereas operation of the scoring shaft compensator (292) varies the position of the adjustable knives (360) through the medium of transfer gears (384). Servo-sensors (438–442, 446–448 and 270) are used to continuously monitor the lateral and circumferential positions of the scoring/slotting stations (296–304) and a reference position of the pusher element (172), so that precise makeready adjustments can be accomplished.

4 Claims, 11 Drawing Sheets

62
62a
72
74
76
102
104
106
156
170
178
179
180
182
184
186
190
195
196
198
200
202
204
210
212
214
216
218
220
222
224
226
234
236
238
240
242
244
246
248
250
252
254
256
258
262
264
266
268
270
272
280
282

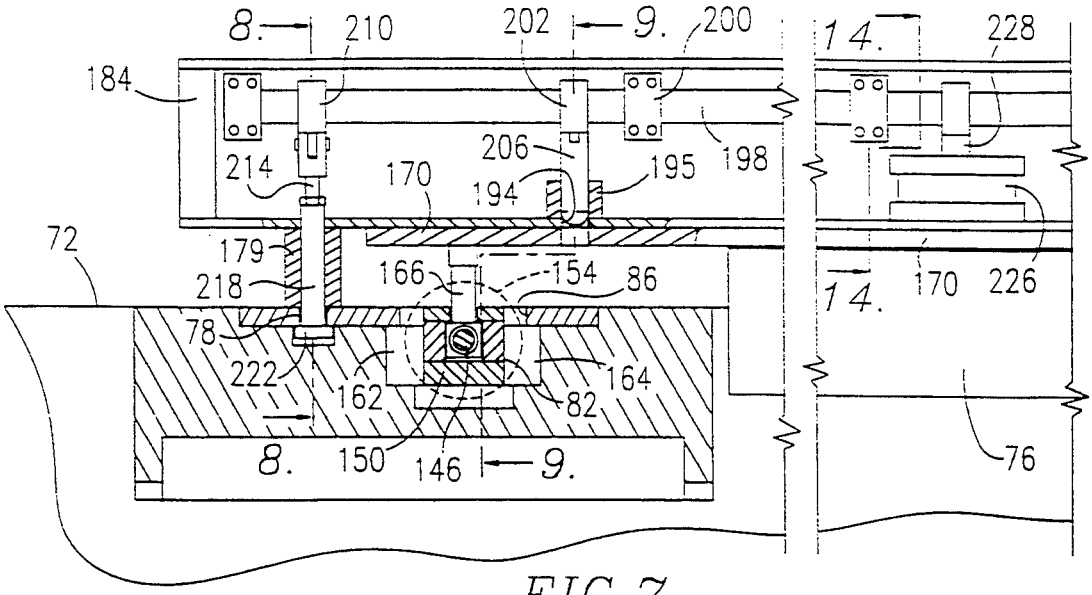
FIG. 7.
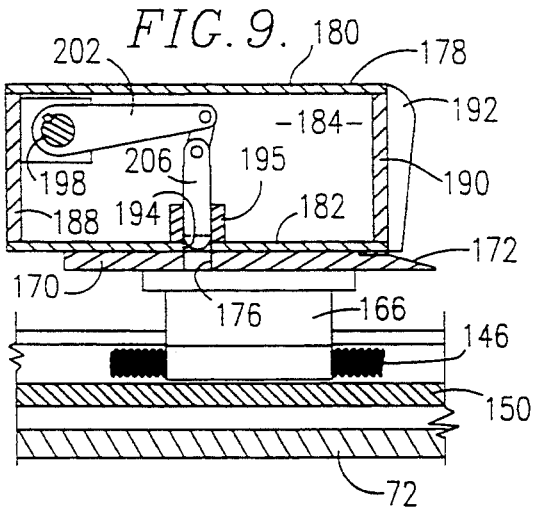
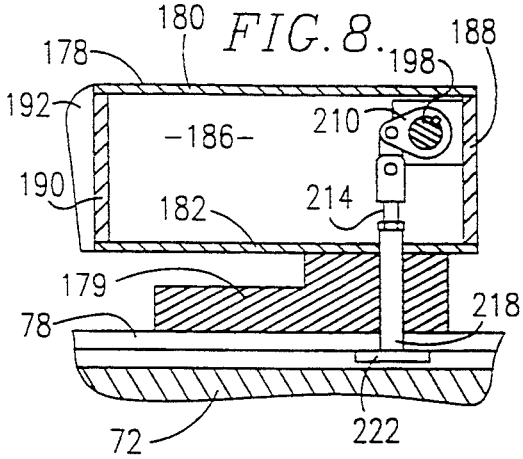
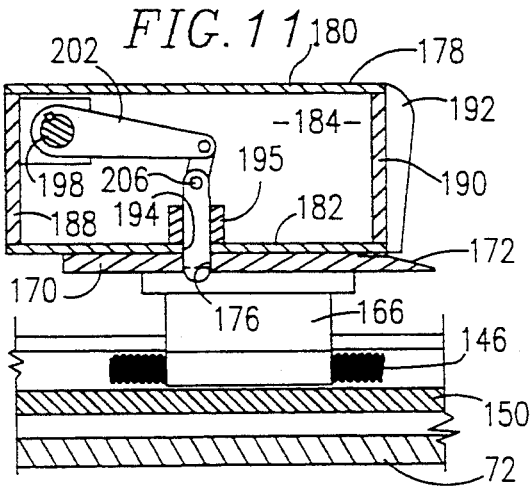
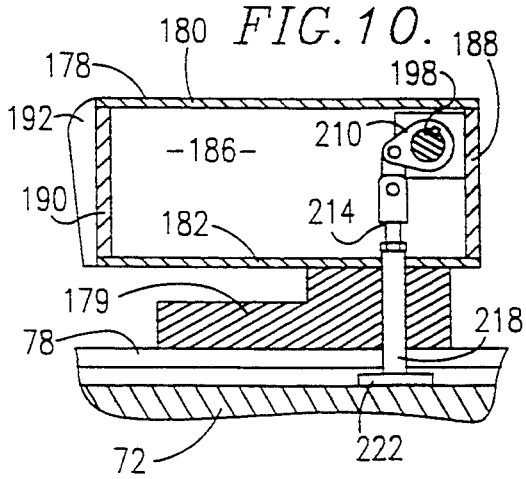

386
350
342
348
346
324
330
322
306
298
288
314
274
310
340
326
320
286
358
352
384
318
316
372
374
276
312
308
112
290
338
378
339

298
386
332
370
360
324
286
350
288
310
306
274
340
355
356
362
384
354
358
344
336
366
368
276
312
308
112
372
380
338
290
339
378

RECIPROCATING SHEET FEEDER APPARATUS FOR BOX BLANK FABRICATION EQUIPMENT HAVING AN ADJUSTABLE PUSHER ELEMENT

This application is a division of application Ser. No. 07/924,625, filed on Aug. 3, 1992, now U.S. Pat. No. 5,246,222, which is a division of Ser. No. 07/835,534, filed Feb. 14, 1992, now U.S. Pat. No. 5,181,899.

BACKGROUND OF THE INVENTION

1. Field of the Invention

The present invention is broadly concerned with improved apparatus for scoring and slotting of cardboard sheets in order to form box blanks. More particularly, it is concerned with such apparatus which can be readily retrofitted on existing, old style equipment, while also permitting extremely rapid and accurate makeready adjustments of the slotting knives of the apparatus and the sheet feeding assembly thereof.

2. Description of the Prior Art

Box-making plants universally make use of large equipment designed for the high speed fabrication of box blanks from starting cardboard sheets. In general, these machines are operable to individually feed cardboard sheets from a stack thereof into a scoring and slotting assembly wherein the sheets are appropriately scored and slotted to form the side panels and end flaps required for box blanks. The scoring and slotting assembly in turn includes two pairs of side-by-side shafts. One shaft pair carries a plurality of laterally spaced apart scoring wheels and cooperating anvils for forming continuous score lines in the incoming sheets. The adjacent shaft pair carries a similar plurality of adjustable and continuous slotting wheels which form the flap-defining slots in the box blank.

Machines of this character operate with good efficiency once they are properly adjusted, i.e., the fixed and adjustable knives of the slotting wheels are properly positioned relative to each other and in conjunction with the sheet feeding assembly of the machine. However, once a particular production run has been completed, it is often necessary to adjust the lateral and circumferential positions of the scoring/slotting stations and the fixed and adjustable knives thereof. Moreover the initial or zero position of the feeding assembly must be adjusted to accept a different size of starting sheet. Such adjustments have heretofore required the machine operator to manually change the feeder assembly zero position, and to alter the positions of at least the adjustable knives of the slotting wheels. The latter requires that the operator individually change each knife, in the crowded confines of the machine. This is not only time-consuming and difficult, but can lead to inaccuracies if the knives are not precisely repositioned. Indeed, makeready changeovers of this character can often take twenty minutes or more, which represents a significant down time for the equipment, particularly where a number of the changeovers are required on a daily basis.

U.S. Pat. No. 4,090,433 describes a scoring/slotting apparatus provided with dual compensators for facilitating the rapid adjustment of the fixed and movable knives of such apparatus. However, the structural arrangement described in this patent does not lend itself to ready retrofitting of existing equipment. This is a prime deficiency, inasmuch as the box making industry has a substantial investment in its existing equipment, and would be loathe to invest in wholly new scoring/slotting apparatus simply to obtain faster makeready capability.

SUMMARY OF THE INVENTION

The present invention overcomes the problems outlined above, and provides a greatly improved scoring/slotting apparatus for the making of box blanks wherein adjustment structure is included permitting rapid, precise machine adjustments for makeready purposes.

In one aspect of the invention, adjustable apparatus for feeding successive sheets from a stack thereof into the input end of a scoring/slotting device is provided. Such apparatus includes a shiftable, sheet-engaging pusher element mounted for selective reciprocal movement thereof and adapted to successively engage the lowermost sheet of a stack and to push the engaged sheets into the scoring/slotting device. Adjustment of the feeder assembly is accomplished by means of, preferably, a pair of elongated, threaded, axially rotatable, fore and aft extending screws which are mounted for selective fore and aft translatory movement. The pusher element is operably coupled with the translatory screws such that, upon axial rotation of the screws the pusher element may be adjusted relative to the screw. Thus, during makeready operations, the positioning screws may be rotated to change a reference position of the pusher element.

In another aspect of the invention, the scoring/slotting assembly and feeding assembly of the overall device are correlated through provision of means sensing the circumferential positions of the fixed and adjustable slotting knives, and for sensing a reference position of the pusher element. Respective motive means are coupled with the slotting knives and pusher element for appropriate adjustment thereof to assure properly correlated operation of the feeding and scoring/slotting assemblies.

Adjustment of the fixed and adjustable slotting knives is accomplished by means of a pair of motor operated compensators. One compensator is operably coupled with a slotting shaft carrying individual slotter wheels bearing the fixed and adjustable knives; this compensator is designed for altering the position of the fixed knives. The second compensator is operably coupled with the adjacent scoring shaft. Each scoring wheel is coupled via transfer gears to the adjustable knives on the adjacent slotter wheels so that, upon compensator-driven rotation of the scoring shaft, the circumferential positions of the adjustable knives may be varied.

The apparatus of the invention may be readily retrofitted on existing box blank-forming equipment, at a cost substantially less than that of new equipment. At the same time, the apparatus hereof permits very rapid makeready adjustments as well as fine, on-the-go slotting knife position adjustments which may be required during initial phases of a production run. As a consequence, makeready time between production runs can be substantially reduced as compared with conventional practice.

BRIEF DESCRIPTION OF THE DRAWINGS

FIG. 7 is a fragmentary vertical sectional view showing details of construction of the feeder assembly;

FIG. 8 is a vertical sectional view taken along line 8—8 of FIG. 7 and illustrating the backstop clamping mechanism;

FIG. 9 is a vertical sectional view taken along line 9—9 of FIG. 7 and showing the positioning screw and locking pin apparatus forming a part of the feeder assembly;

FIG. 10 is a view similar to that of FIG. 8, but showing the clamping assembly in its released position;

FIG. 11 is a view similar to that of FIG. 9, but showing the locking pin in its lowered position for interconnecting the backstop and pusher element;

DETAILED DESCRIPTION OF THE PREFERRED EMBODIMENTS

Figure 22:
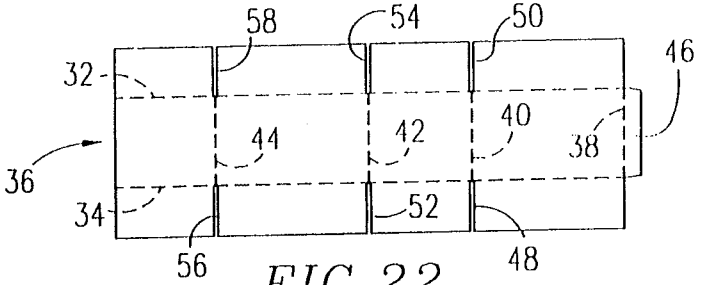
FIG. 22 is a plan view of a final exemplary box blank produced using the apparatus of the invention.
Figure 21:
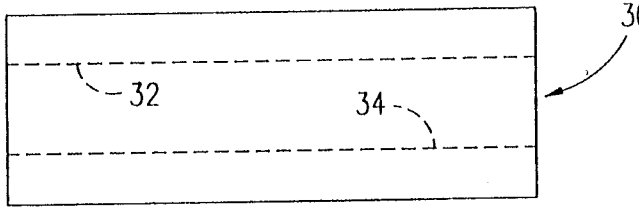
FIG. 21 is a plan view of a cardboard sheet of the type used to make finished box blanks using the apparatus of the invention.

Turning now to the drawings, and particularly FIG. 21, a sheet 30 of cardboard stock or other similar material is illustrated. This sheet is rectangular in configuration and has a pair of elongated, spaced apart score lines 32, 34 therein. These score lines are provided by apparatus not shown, so as to present a sheet 30 designed for blank forming operations. FIG. 22 depicts a final box blank 36 as it would appear after processing in the apparatus of the invention. To this end, the completed blank 36 has a total of four laterally spaced apart score lines 38–44 therein which are transverse with the lines 32–34; in addition, a glue flap 46 is provided. The completed blank 36 also has a pair of slots 48, 50 in alignment with score line 40, and similar aligned pairs of slots 52, 54 and 56, 58 aligned with the score lines 42, 44. In this fashion, the blank presents the usual side-wall panels for a completed box, together with end flaps.

Figure 1:
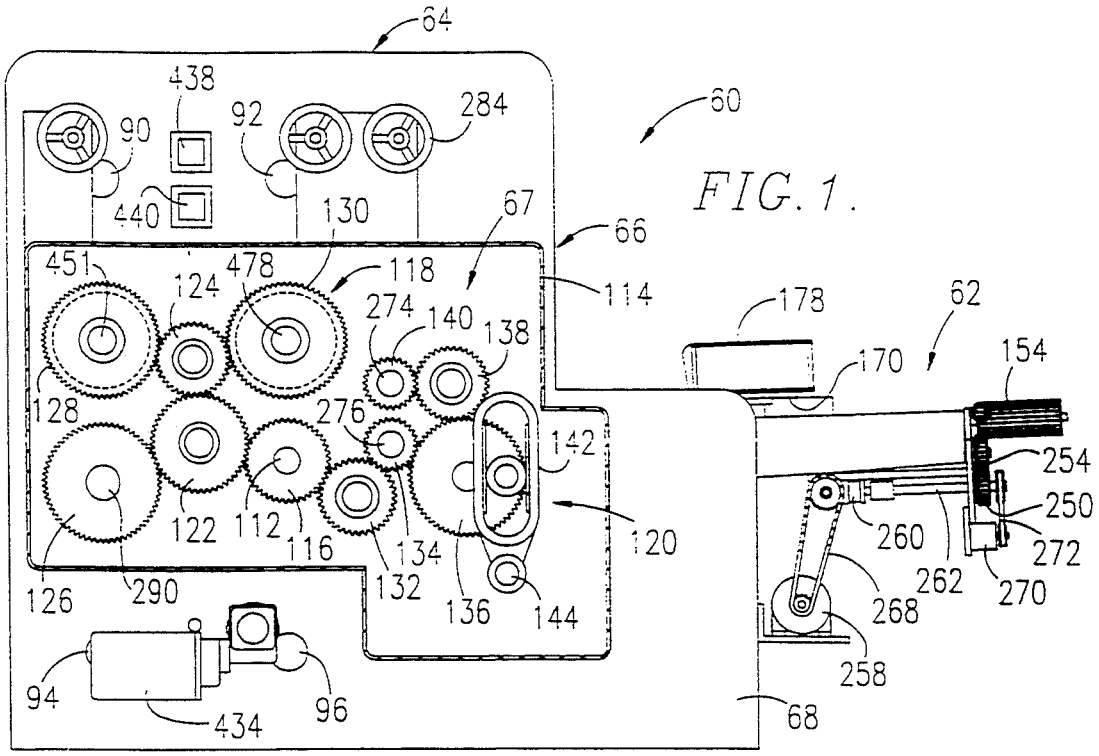
FIG. 1 is a side view of the improved box blank-forming apparatus of the invention, illustrating certain aspects of the mechanical drive for the apparatus.
Figure 3:
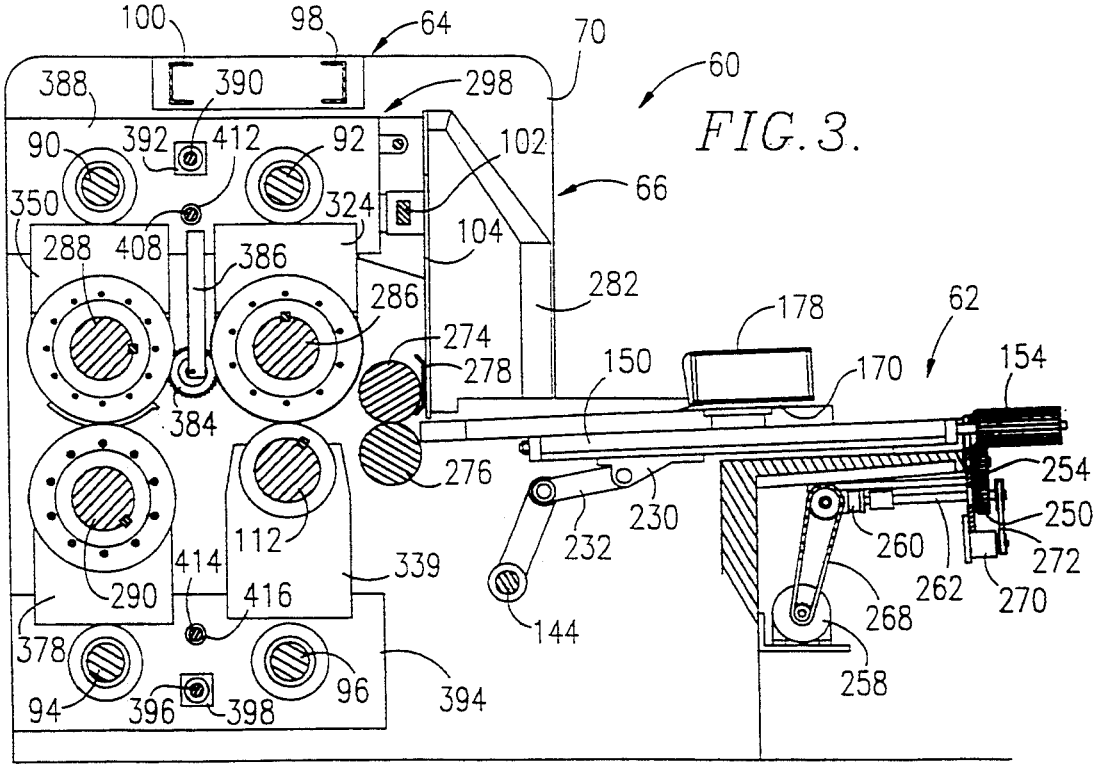
FIG. 3 is a vertical sectional view illustrating the main components of the scoring/slotting assembly, as well as those of the feeder assembly.
Figure 4:
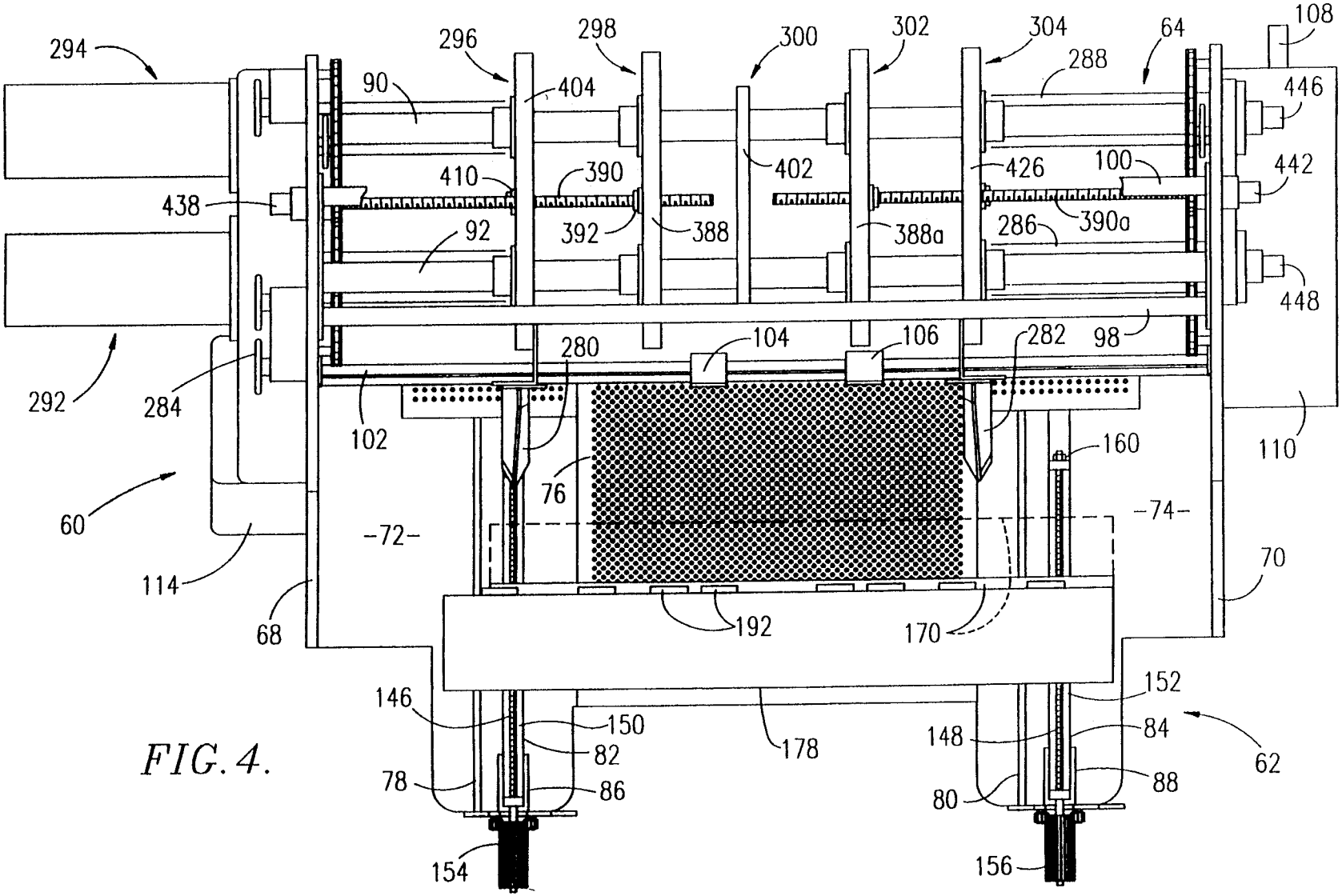
FIG. 4 is a plan view with parts broken away of the improved scoring/slotting and feeder assemblies.
Figure 5:
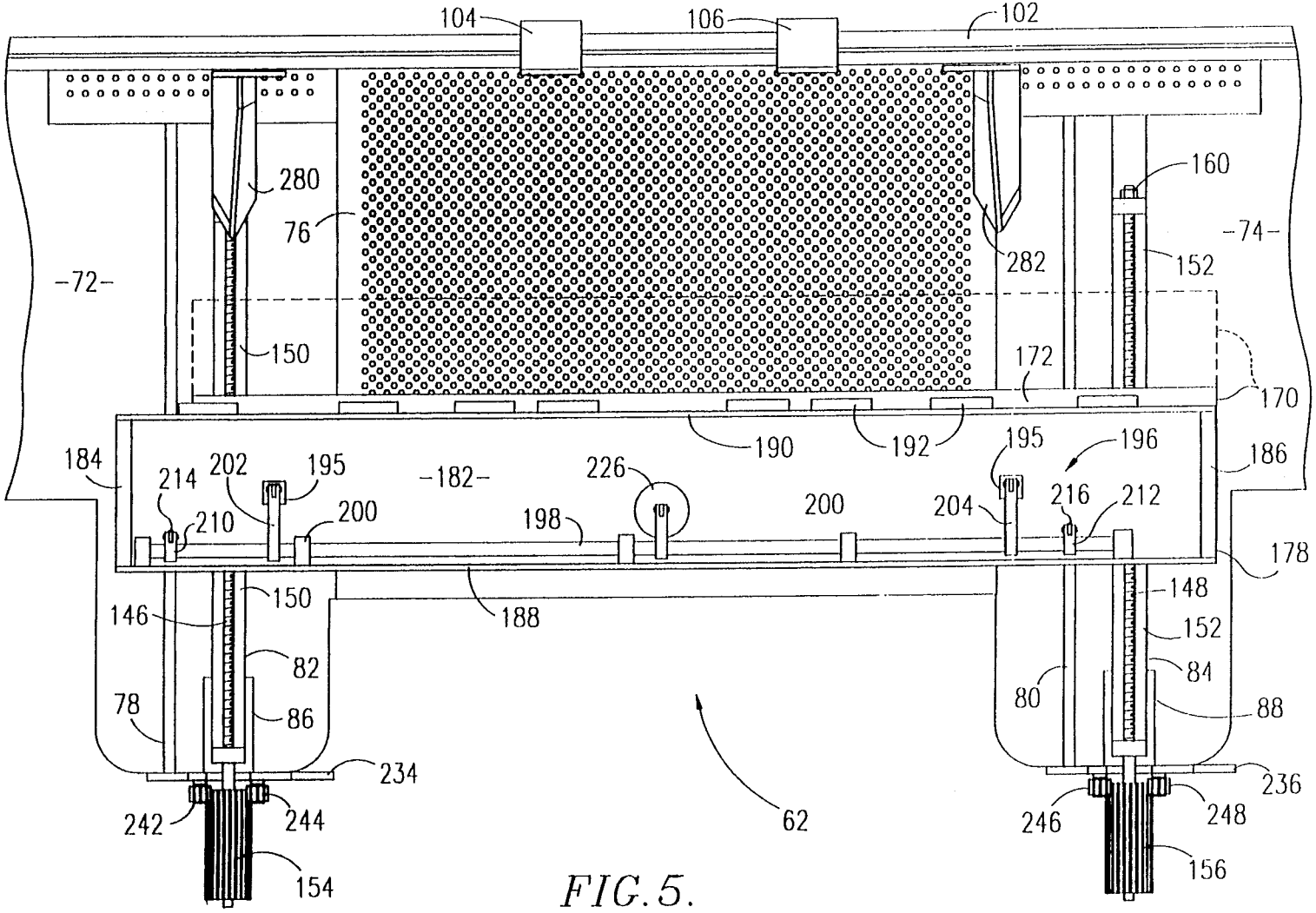
FIG. 5 is a view similar to that of Fig- 4, but illustrating in more detail the feeder assembly and the operation of the pusher element thereof.

Attention is next directed to FIGS. 1 and 3–4 which depict the blank-forming apparatus 60 of the invention. The latter broadly includes a feeder assembly 62 defining the input end of the machine as well as a scoring/-slotting assembly 64 adapted to receive individual sheets 30 from the feeder assembly and to process the same to form a completed blank 36. The assemblies 62, 64 are supported in their operative dispositions by means of a frame assembly 66 and are driven via a drive assembly 67; adjustment structure broadly referred to by the numerals 62*a*, 64*a* is also provided. It will of course be appreciated that a commercial apparatus may also and would normally be equipped with downstream counting and bundling apparatus for the purpose of receiving finished blanks for bundling and customer shipment.

In more detail, the frame assembly 66 includes a pair of elongated, upright machine sidewalls 68, 70, as well as a pair of input end table sections 72, 74. An apertured vacuum table 76 extends between the table sections 72, 74 and is adapted for connection to a blower so as to create a hold-down vacuum on the surface of the table 76. In addition, each of the sections 72, 74 is provided with an elongated clamp slot 78, 80, as well as an elongated, fore and aft extending track slot 82, 84; the latter are provided with enlarged openings 86, 88 at the outboard ends thereof for purposes to be made clear.

The frame assembly further includes a pair of upper guide shafts 90, 92 and corresponding lower guide shafts 94, 96; the shafts 90, 92 extend between and are coupled with the sidewalls 68, 70, and as shown the shafts 90, 94 are in vertical alignment, as are shafts 92, 96. A pair of cross-channels 98, 100 extend between the sidewalls 68, 70 (see FIG. 4). Also, a stationary support bar 102, carrying a pair of laterally shiftable stops 104, 106, is secured to the sidewalls 68, 70 adjacent the input end of assembly 64.

The drive assembly 67 operates off of the main machine drive (not shown) via an input shaft 108 and gear box 110. A transverse shaft 112 extends from gear box 110 to a secondary gear box 114 mounted on sidewall 68. The shaft 112 serves as the lower score shaft later to be described. However, the end of shaft 112 within gear box 114 has a gear 116 keyed thereto. The gear 116 is in turn operatively coupled with a pair of gear trains 118, 120 respectively forming a part of the drives for the slotter/scoring assembly 64 and feeder assembly 62. Gear train 118 includes a transverse idler gear 122 in mesh with gear 116, together with a transfer gear 124 in driving engagement with the gear 122. A lower slotter shaft gear 126 is in mesh with the gear 122, whereas an upper slotter shaft input compensator gear 128 meshes with transfer gear 124.

Gear train 120 includes an idler 132 in engagement with gear 116, along with a lower score shaft gear 134 engaging idler 132. A large feeder drive gear 136 is drivingly coupled with gear 134, and has an idler 138 in mesh therewith. An upper feed roller gear 140 is in mesh with the idler 138. A feeder drive yoke 142 is coupled with the gear 136, with the yoke being coupled with a feeder drive shaft 144 later to be described.

The feeder assembly 62 includes a pair of elongated, fore and aft extending, threaded, axially rotatable positioning screws 146, 148 each situated within an elongated, generally U-shaped in cross-section slider box 150, 152. The outboard ends of the screws 146, 148 are equipped with elongated gears 154, 156, whereas the opposite ends of the screws are equipped with nuts 158, 160 so as to captively retain the screws within their respective slider boxes. Each slider box/screw combination is translatable in a fore and aft fashion within a corresponding track slot 82, 84. In order to facilitate such fore and aft translatory movement, each of the track slots has a pair of nylon glides 162, 164 therein (see FIG. 7).

Each of the positioning screws 146, 148 is equipped with an elongated, internally threaded standoff 166, 168 which are threaded onto the corresponding screws and extend above the table sections 72, 74 to a height approximately equal to that of vacuum table 76. The standoffs support, at their upper ends, an elongated, transversely extending, plate-like pusher element 170. The pusher element 170 includes a beveled, sheet-engaging surface 172, and has a hardened metallic sheet-pushing insert 174 adjacent the upper end thereof. It will also be observed that the pusher element 170 has a pair of laterally spaced apart locking apertures 176 therethrough.

Figure 6:
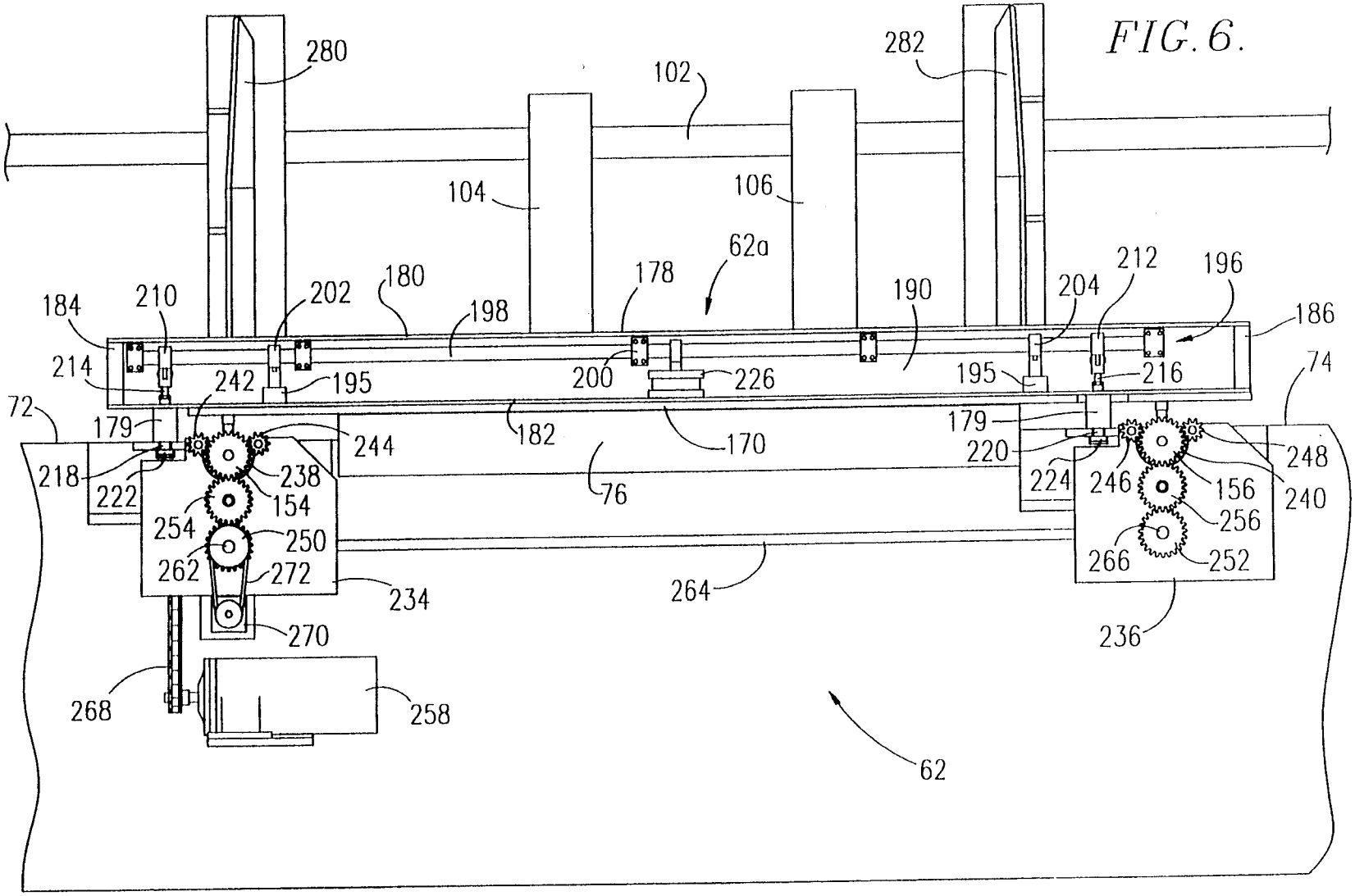
FIG. 6 is a front view with parts removed for clarity further depicting the construction of the feeder assembly.
Figure 13:
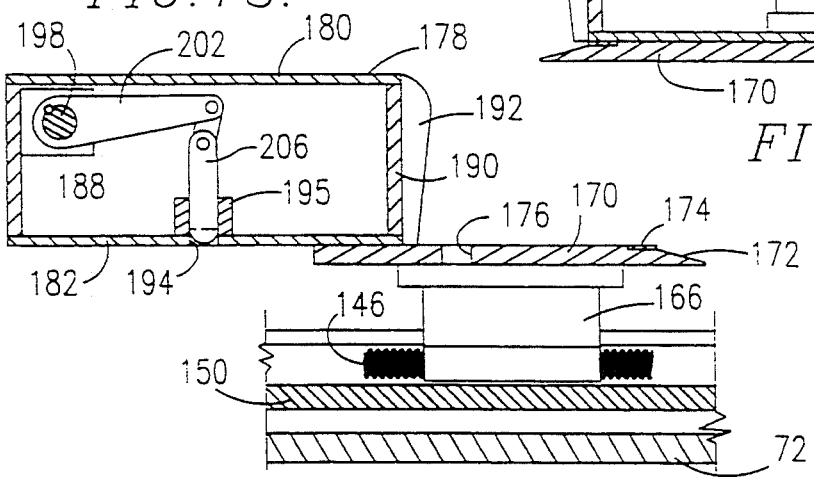
FIG. 13 is a vertical sectional view taken along line 13—13 of FIG. 12 and illustrating the pusher element in its forwardmost position relative to the backstop.
Figure 14:
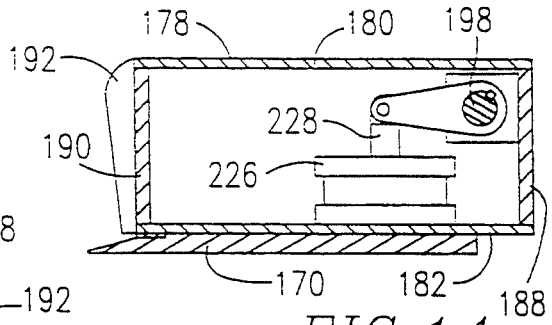
FIG. 14 is a vertical sectional view taken along line 14—14 of FIG. 7 and showing the short-stroke piston and cylinder assembly carried by the backstop of the feeder assembly.
Figure 12:
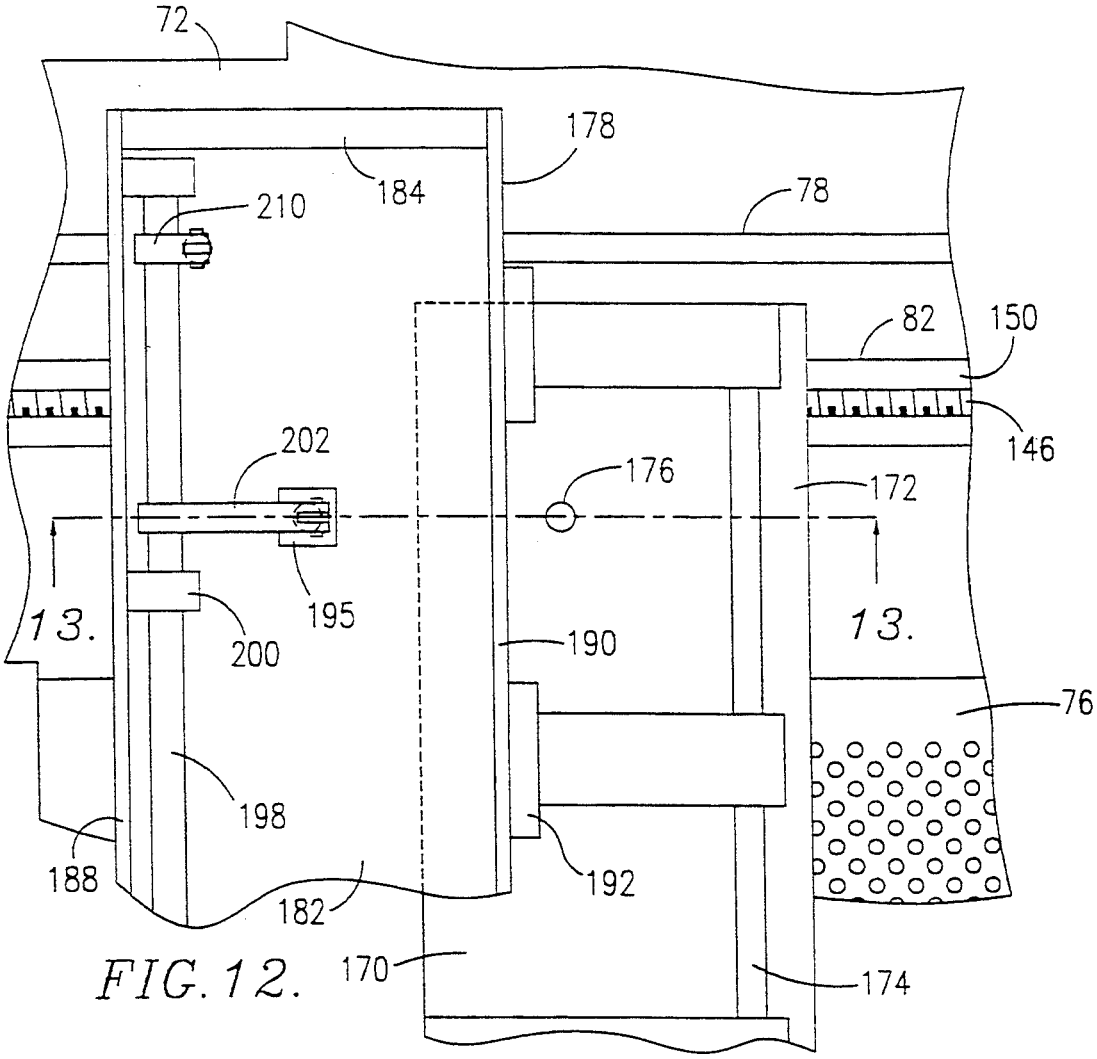
FIG. 12 is a fragmentary top view depicting details of the backstop, pusher element and support table forming a part of the feeder assembly.

An elongated, transversely extending, rectangular, box-like backstop 178 is supported in spanning relationship across the table sections 72, 74 by means of a pair of apertured mounting blocks 179 (see FIG. 6). The backstop presents a top wall 180, bottom wall 182, sidewalls 184, 186, rear wall 188 and forward wall 190, the latter supporting a plurality of laterally spaced apart sheet guides 192. In addition, the bottom wall 182 includes a pair of apertures 194 therethrough which are oriented to align with the apertures 176 of pusher element 170 when the latter is in its retracted position as will be described. An upright bushing 195 is also in alignment with each aperture 194 as shown.

A locking assembly 196 is situated within the confines of backstop 178 and includes an elongated pivot shaft 198 positioned adjacent rear wall 188 and supported on pivot blocks 200. The shaft 198 carries a pair of spaced linkage arms 202, 204 which in turn pivotally support an upright locking pin 206, 208. The pins 206, 208 are oriented for passage through the bushings 195 and apertures 194 provided in the backstop, upon pivoting of shaft 198.

The shaft 198 also carries a pair of short links 210, 212 which in turn pivotally support a pair of clamping elements 214, 216. As best viewed in FIGS. 7 and 8, each of the clamping assemblies 214, 216 includes an elongated shaft 218, 220 which extend through the apertures of the associated mounting blocks 179, with an enlarged clamping head 222, 224 being secured to the lower end of a corresponding shaft. The lowermost end of each shaft 218, 220 and the corresponding heads 222, 224 are received within the clamping slots 78, 80 provided in the table sections 72, 74.

The overall locking assembly 196 further includes a central, snort-stroke pneumatic piston and cylinder assembly 226 having an extensible piston rod 228 coupled to pivot shaft 198. Extension and retraction of the piston rod 228 in turn pivots the shaft 198, thereby appropriately moving the locking pins 206 and clamping assemblies 214, 216.

Figure 15:
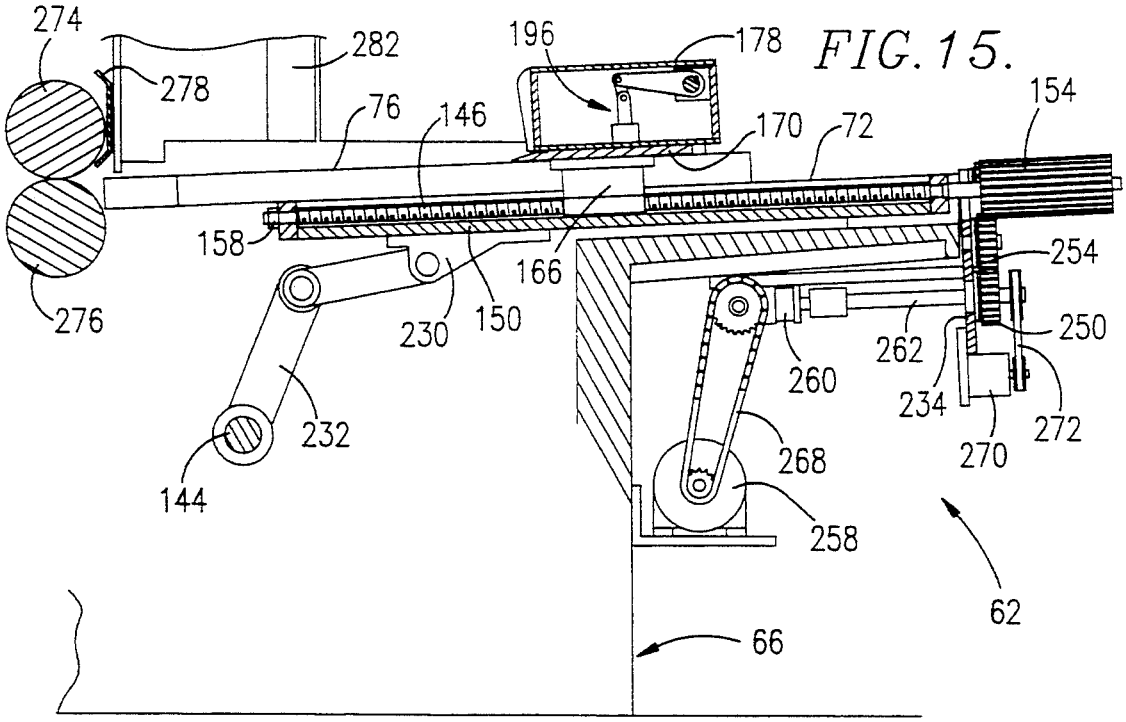
FIG. 15 is a fragmentary vertical sectional view illustrating the feeder assembly with the pusher element thereof in its fully retracted position.

As described previously, the slider boxes 150, 152 and their associated positioning screws 146, 148 are translatable fore and aft within the associated track slots 82, 84. To this end, a bracket 230 is secured to the underside of each slider box (see FIGS. 3 and 15), together with a two-part linkage assembly 232. The lower end of each linkage assembly 232 is coupled with feeder drive shaft 144 described previously; accordingly, upon pivoting of the feeder drive shaft 144, the respective slider boxes 150, 152 reciprocate within their associated track slots.

A depending gear drive support plate 234, 236 is secured to the outboard ends of each table section 72, 74 as best seen in FIG. 6. The upper end of each plate 234, 236 is provided with an arcuate recess 238, 240 so as to accommodate fore and aft shifting movement of the elongated gears 154, 156. In order to assure smooth reciprocation of these gears, two pairs of small hold-down gears 242, 244 and 246, 248 are respectively pinned to each plate 234, 236 on opposite sides of the elongated gear 154, 156. Each of the plates also supports a drive gear assembly including a drive gear 250, 252 and an intermediate idler gear 254, 256 in meshing engagement with the associated drive gear and the elongated gear thereabove (see FIG. 6). It will be observed in this respect that the drive and idler gears are of substantially less thickness than the length of the elongated gears 154, 156, thereby permitting reciprocation of these elongated gears while maintaining a driving engagement with the respective driving gear assemblies.

In order to provide motive power for the drive gear assemblies, a drive motor 258 is supported beneath plate 234. In addition, an angled gear box 260 (see Fig. 3) is provided beneath table section 72 and has an output shaft 262 coupled with drive gear 250. A transversely extending drive shaft 264 also extends from the gear box 260 and leads to another right angle gear box (not shown) behind plate 236. A short output shaft 266 extends from this angled gear box and is keyed to drive gear 252. A drive chain 268 is employed to complete the connection between motor 258 and gear box 260.

A servo-sensor 270 is secured to the bottom of plate 234, and is coupled, via belt 272, to shaft 262 supporting drive gear 250; this servo-sensor is designed to sense a reference position of the pusher element 170 and backstop 178.

The scoring and slotting assembly 64 is positioned downstream of the feeder assembly 62, and is designed to receive individually fed sheets and provide appropriate score lines and slots therein, together with glue tab formation and trimming, so as to create a final box blank.

The inlet end of the assembly 64 includes a pair of feed rollers 274, 276 which are coupled with the gears 140, 134 for powered counterrotation. Rollers 274, 276 extend transversely between the sidewalls 68, 70. In order to assure even feeding of individual sheets between the rollers 274, 276, an elongated, transversely extending entry guide 278 is located immediately behind the upright stops 104, 106. Additionally, a pair of laterally spaced apart and shiftable upright sheet guides 280, 282 are provided which extend rearwardly from the stops 104, 106 and aid in controlling a stack of sheets placed on vacuum table 76. A handwheel 284 is connected to a conventional nip adjust mechanism (not shown) permitting manual adjustment of the nip pressure between the feed rollers 274, 276

Figure 17:
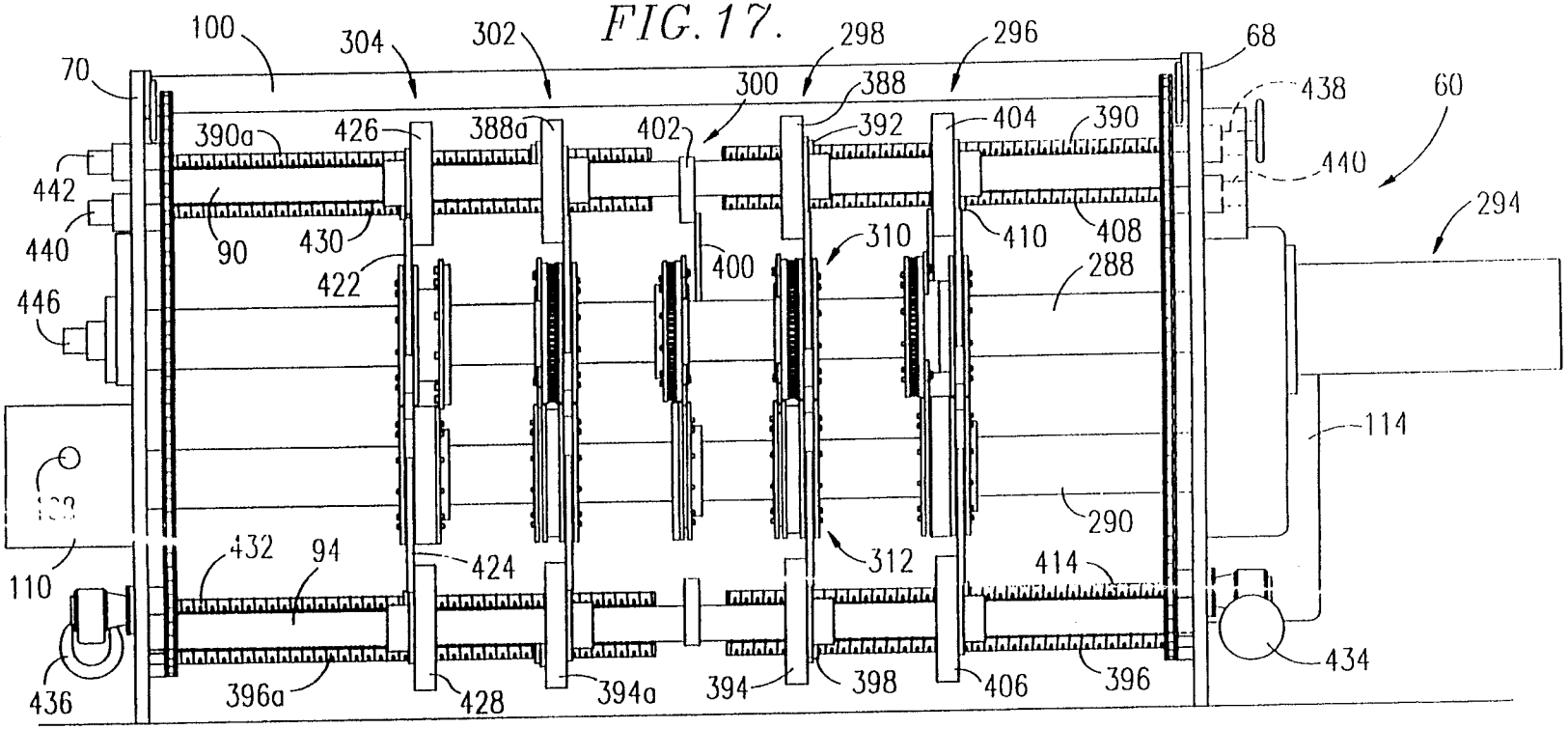
FIG. 17 is a rear view illustrating the construction of the scoring/slotting assembly.
Figure 20:
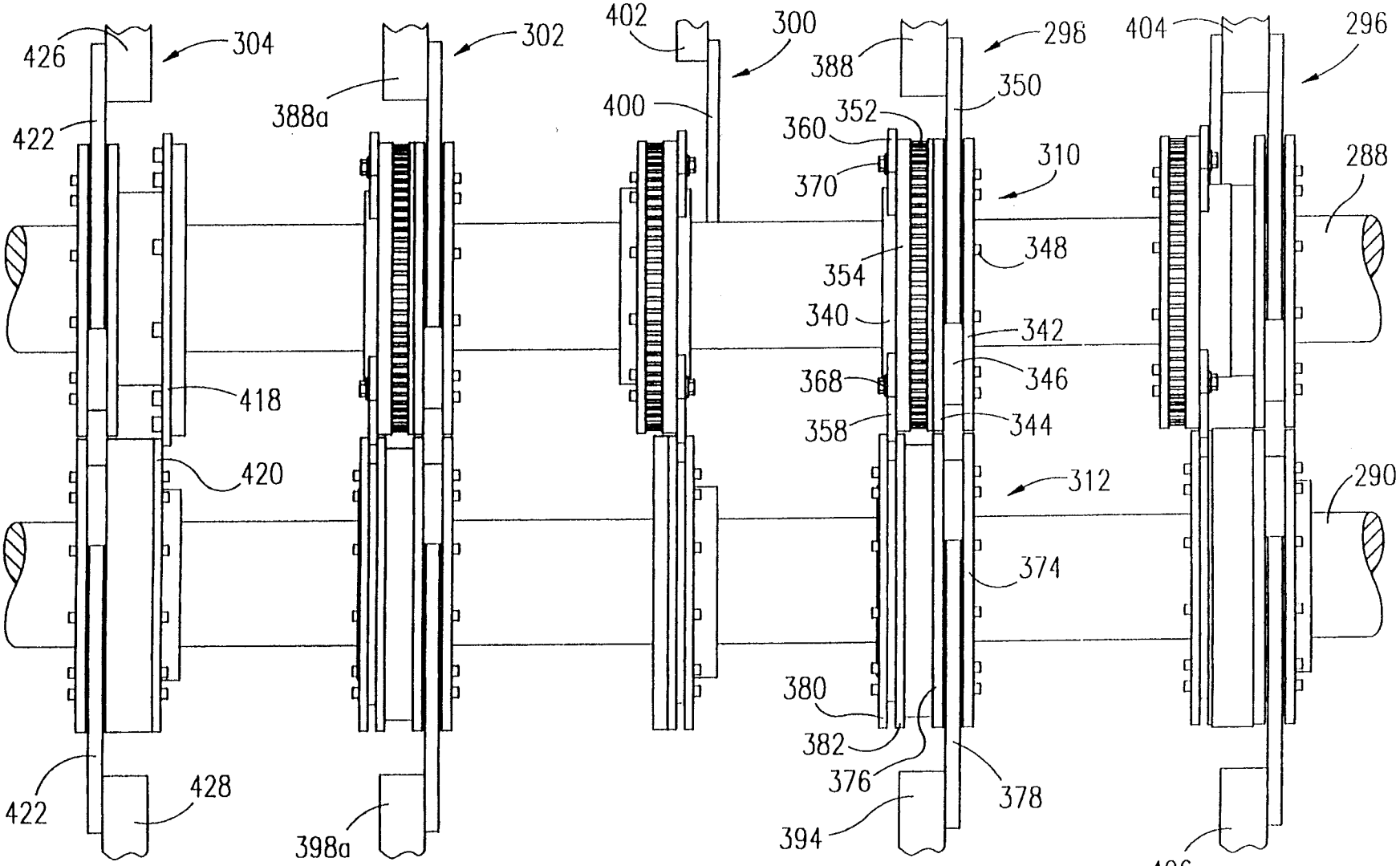
FIG. 20 is a fragmentary top view illustrating the five stations of the scoring/slotting assembly.

Attention is next directed to FIGS. 17 and 20 which illustrate the scoring and slotting devices forming a part of the assembly 64. Specifically, a total of four axially rotatable cross-shafts are provided between the sidewalls 68, 70, namely upper score shaft 286, lower score shaft 112, and upper and lower slotting shafts 288, 290. The shafts 112, 290 are coupled to drive gears 116, 126 (see FIG. 1), whereas the upper shafts 286, 288 are respectively connected with compensator mechanisms 292, 294 (FIG. 2) which include respective compensator input gears.

Figure 2:
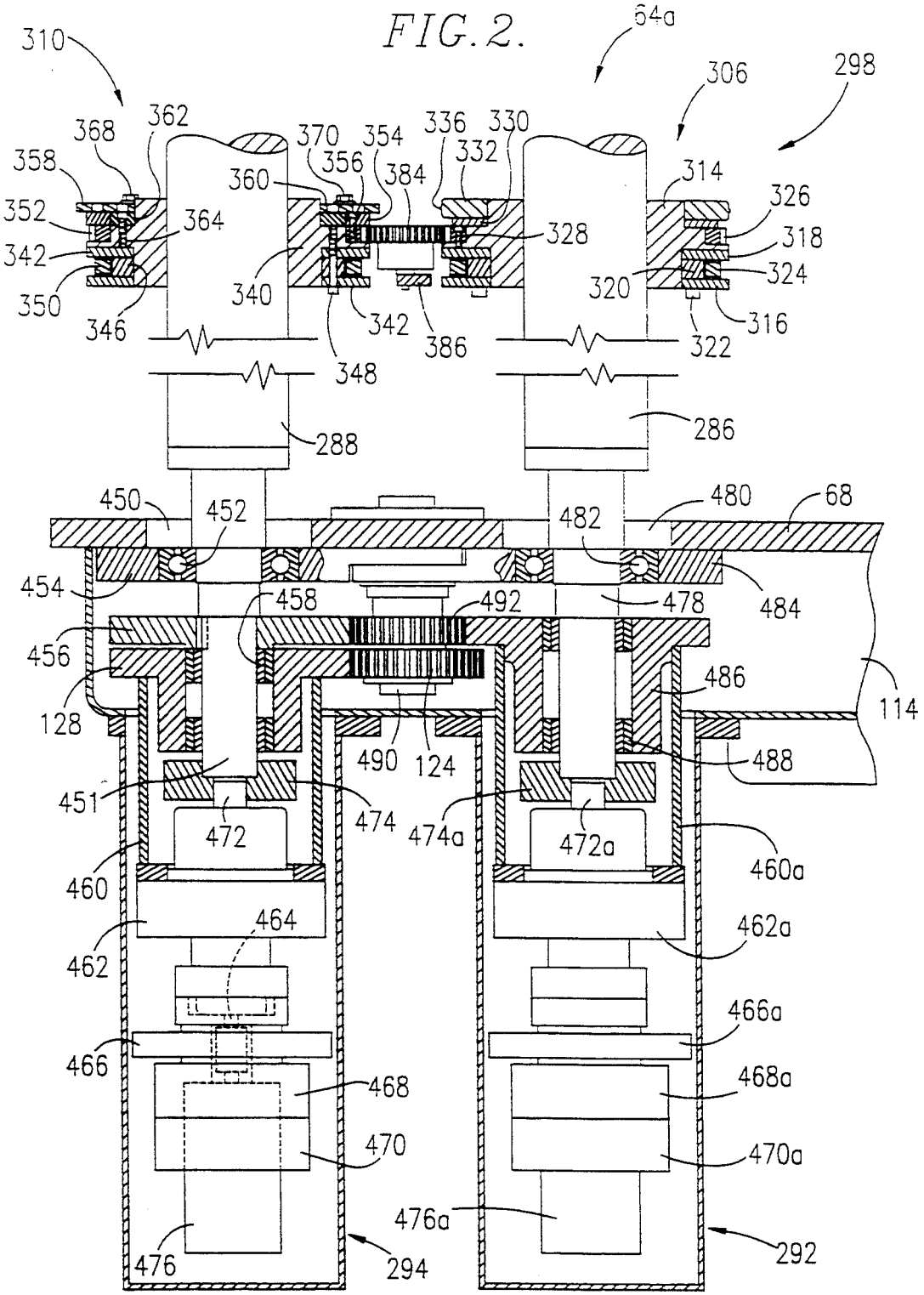
FIG. 2 is an enlarged, fragmentary sectional view illustrating the details of the twin compensators used for knife adjustment in the apparatus.
Figure 18:
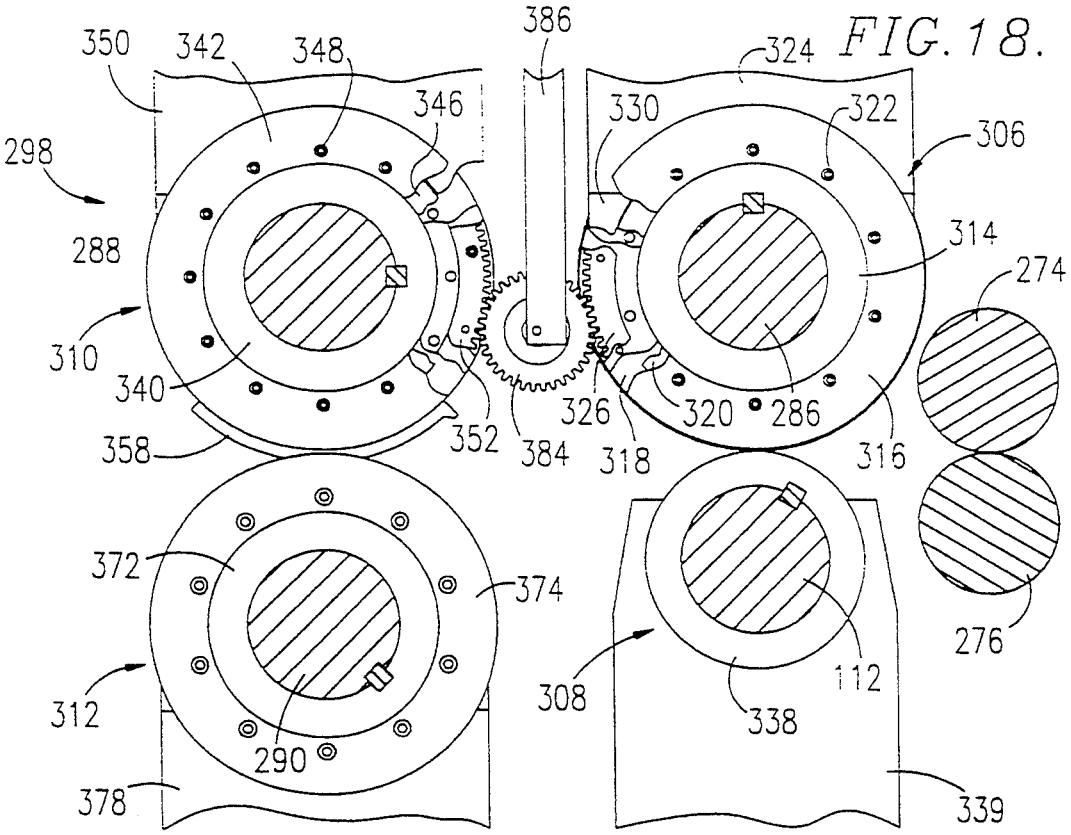
FIG. 18 is an enlarged fragmentary view depicting the orientation and construction of laterally adjacent scoring and slotting wheels forming a part of the scoring/slotting assembly.

Turning now to FIGS. 2 and 20, it will be observed that the assembly 64 is provided with a total of five laterally spaced apart scoring/slotting stations 296, 298, 300, 302, 304, with the stations 298 and 302 being identical. Exemplary station 298 is illustrated in complete detail in FIGS. 18–19. Specifically, the station 298 includes an upper scoring wheel assembly 306 mounted on shaft 286, a lower scoring wheel assembly 308 keyed to shaft 112, an upper slotter wheel assembly 310 coupled with shaft 288, and a lower slotter wheel assembly 312 connected to shaft 290.

The upper scoring wheel assembly 306 includes a central hub 314 keyed to shaft 286 and supporting a pair of annular, spaced apart guide rings 316, 318 separated by spacer 320. The guide ring and spacer assembly is coupled to hub 314 by means of screws 322. An upright yoke 324 is captively retained between the guide rings 316, 318 as shown. A peripheral ring gear 326 is also affixed to hub 314 by means of screws 328, and the assembly 306 is completed by means of an annular spacer 330 and scoring ring 332, the latter components being affixed to the hub by means of screws 334. It will be observed that the scoring ring is provided with an outermost annular protrusion 336 in order to provide the necessary scoring action.

The lower scoring wheel assembly 308 consists simply of an annular anvil ring 338 keyed to shaft 112 and presenting a flattened resilient outer surface to coact with protrusion 336. A retaining ring (not shown) is also affixed to ring 338 in order to captively retain a depending yoke 339.

The upper slotter wheel assembly 310 includes a central hub 340 keyed to shaft 228 and provided with a pair of spaced annular guide rings 342, 344 separated by spacer 346, with the guide ring/spacer subassembly being affixed to the hub by means of screws 348. An upwardly extending yoke 350 is captively retained between the guide rings 342, 344 as shown. A rotatable, annular ring gear 352 is also provided, which is rotatably mounted to hub 340 by means of an outer pull ring 354 and screws 356, such that the ring gear 352 and pull ring 354 are rotatable relative to hub 340. The outer pull ring 354 is also provided with a plurality of threaded bores 355 therein.

Figure 19:
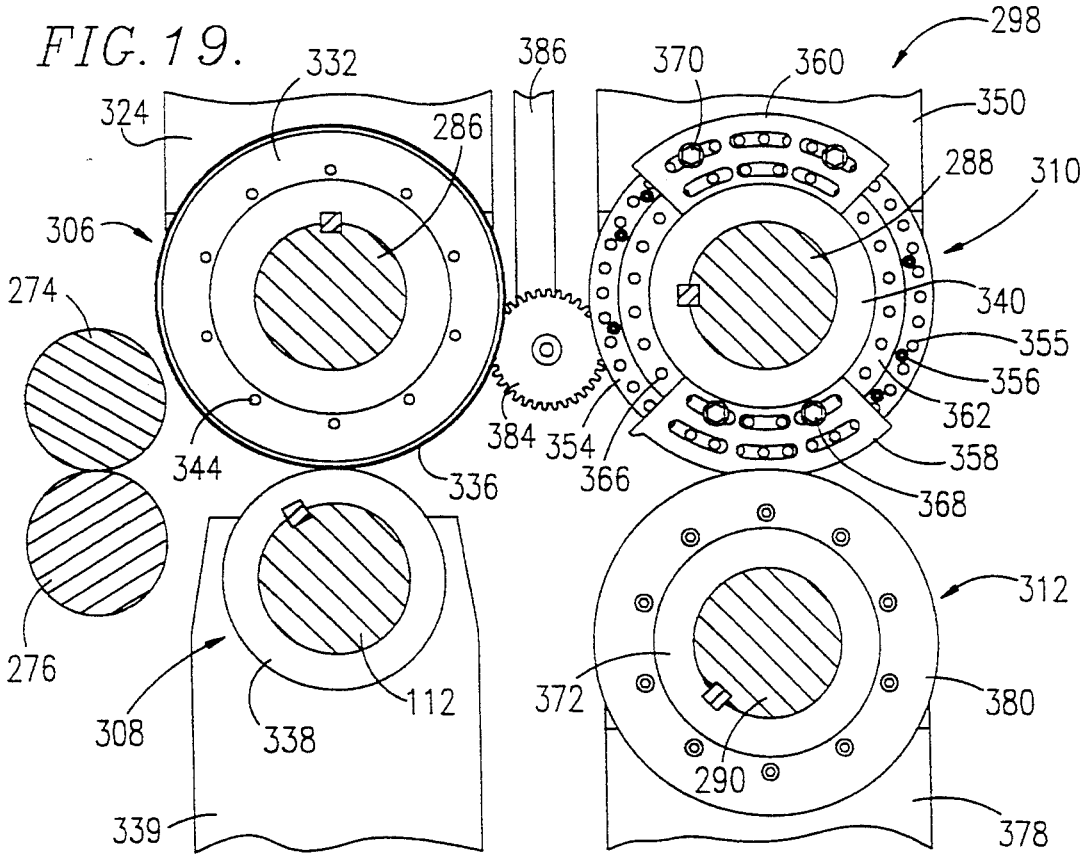
FIG. 19 is a view similar to that of FIG. 18, but depicting the scoring and slotting wheels as viewed from the side opposite that shown in FIG. 18.

The wheel assembly 310 supports a pair of slotting blades, specifically a tipped, fixed slotting blade 358 and an adjustable slotting blade 360. Each of these knives is provided with a plurality of arcuate mounting slots therein, as best seen in FIG. 19. The fixed blade 358 is secured in place by means of an insert ring 262 inboard of outer pull ring 354 and attached by means of screws 364. The insert ring is provided with a series of threaded apertures 366 therein, and a pair of screws 368 serve to affix the blade 358 to the insert ring 362, these screws 368 passing through blade mounting slots and into appropriate threaded apertures 366.

The adjustable blade 360 is secured to the outer pull ring 354 by means of screws 370 passing through the blade mounting slots and into appropriate threaded apertures 355 therein.

The lower slotter wheel assembly 312 includes a hub 372 keyed to shaft 290 and supporting a pair of outwardly extending guide rings 374, 376. A depending yoke 378 is captively retained between the rings 374, 376. The overall assembly 312 further includes a pair of annular, spaced apart, continuous knife blades 380, 382 (see FIG. 20) which are bolted to the hub and are oriented for receiving therebetween the fixed and adjustable blades 358, 360 of assembly 310 during operation. The interfitting of these blades is shown in detail in FIG. 20.

A rotatable transfer gear 384 is situated between and in mesh with the ring gears 326 and 352 of the assemblies 306, 310. The transfer gear 384 is rotatably supported on an upright 386 situated between the yokes 324, 350.

As best seen in FIGS. 4 and 17, the upwardly extending yokes 324, 350 are secured to a common, fore and aft extending guide member 388 which is mounted and laterally shiftable on the upper shafts 90, 92. The upright 386 is also affixed to the member 388 (see Fig. 3). As can be appreciated, lateral movement of the guide member 388 effects corresponding lateral movement of the upper scoring and slotting assemblies 306, 310. To this end, an elongated, threaded positioning screw 390 is provided which extends from sidewall 68 and is threaded into and through a traversing nut 392 carried by the member 388. Powered rotation of the screw 390, by means to be explained, correspondingly effects lateral shifting movement of the member 388, which in turn moves the upper scoring and slotting assemblies 306, 310 and transfer gear 384 therebetween.

In a similar fashion, the downwardly extending yokes 339, 378 associated with the lower scoring wheel assembly 308 and lower slotting wheel assembly 312 are secured to a fore and aft extending guide member 394 which is laterally shiftable on lower guide shafts 94, 96. Lateral shifting movement of the member 394, and correspondingly that of the lower assemblies 308, 312, is effected by means of elongated, threaded, axially rotatable positioning screw 396 extending inwardly from wall 68. The screw 396 is threaded into traversing nut 398 carried by member 394.

The remaining stations 296 and 300–304 are similar in many respects to station 298, and accordingly a detailed description of these other stations is not required except to explain the differences; as noted, station 302 is in all respects identical to station 298, and accordingly the same reference numerals have been applied, with the addition of the letter "a". Therefore, it will be seen that the station 302 includes the scoring/slotting assemblies mounted on the shafts 286, 112, 288 and 290, as well as the upwardly and downwardly extending yokes associated with each wheel assembly. The upper yokes are secured to a guide member **388*a*, whereas the lower yokes are affixed to guide member 394*a*. Respective positioning screws 390*a* and 396*a* extending from sidewall 70 are threadably received by advancing nuts carried by the members 388*a*, 394*a***, so that rotation of the positioning screws effects lateral adjustment of the scoring and slotting wheel assemblies.

Central station 300 includes the four wheel assemblies of station 298, but in this case, the lateral position of the wheel assemblies is fixed. This station does of course include a central transfer gear (not shown) identical to gear 384, and in mesh between the ring gears of the upper scoring and slotting wheel assemblies. This transfer gear is supported on standard 400, the latter being affixed to stationary block 402 secured to shafts 90, 92.

Station 296 differs from station 298, in that it is equipped with conventional knives designed to form the endmost glue tab 46 on sheets passing through the assembly 64. However, the station does include the ring and transfer gear arrangement for permitting adjustment of the tab-cutting knives in order to form tabs of desired configuration. Referring specifically to FIGS. 4, 17 and 20, it will be seen that each of the four scoring and slotting wheel assemblies of station 296 are provided with upwardly or downwardly extending yokes, with the upper yokes being secured to guide member 404 slidable on shafts 90, 92. The depending yokes are secured to lower guide member 406 slidable on lower shafts 94, 96. The guide member 404 is laterally shiftable by means of elongated, threaded positioning screw 408 extending from sidewall 68 and extending into a traversing nut 410 carried by the guide member. The positioning screw 408 also passes through a clearance opening 412 (see FIG. 3) provided in guide member 388 forming a part of station 298. In a similar fashion, lateral adjustment of lower guide member 406 is accomplished by means of positioning screw 414 extending from sidewall 68 and threaded into a traversing nut carried by guide member 406. The screw 414 likewise passes through a clearance opening 416 in guide member 394 of station 298.

The function of final station 304 is to trim the edges of box blanks remote from the glue flaps 46 during processing. Accordingly, this station differs from those described previously in that it does not make use of fixed and adjustable knives in the slotting wheel assemblies. Rather, the upper and lower slotting wheels (FIG. 20) present a pair of coacting, continuous knife blades 418, 420; also, there are no scoring heads associated with this station. The upper and lower slotting wheel assemblies have upwardly and downwardly extending adjustment yokes 422, 424, with the latter being affixed to corresponding upper and lower guide members 426, 428. The guide member 426 is slidable on upper guide shafts 90, 92, and is adjustable by means of elongated positioning screw 430, and a traversing nut carried by the guide member. The screw 420 likewise passes through a clearance opening in guide member 388*a*. Lower guide member 428 is adjustable through the medium of positioning screw 432 threadably received between a traversing nut assembly carried by the guide member. Again, the screw 432 passes through an appropriate clearance opening in adjacent guide member 394*a*.

In order to assure properly coordinated lateral adjustment of the respective wheels of the stations 296, 298, 302 and 304, the associated positioning screws are appropriately driven in common. Thus, screws 408 and 414, 390 and 396, 390*a* and 396*a*, and 430 and 432 are commonly driven. This is accomplished by means of a drive motor 434 and conventional sprocket and chain drive for the screws 390 and 396; and by means of motor 436 with conventional chain and sprocket drive for the screws 390*a* and 396*a*. The remaining two sets of coordinating positioning screws, i.e., screws 408 and 414, and 430 and 432, are driven by a chain and sprocket drive as a takeoff from the main machine drive motor.

It is also important to sense the lateral position of the respective shiftable stations. For this purpose, a total of four servo-sensors 438, 440, 442, 444, are provided which are respectively associated with the screws 390, 408, 390*a* and 430. Proper adjustment also requires that the position of the fixed and adjustable knives on the slotting wheel assemblies of the stations 296–302 be determined. For this purpose, a pair of servo-sensors 446, 448 are provided, which are respectively operably coupled with the upper shafts 288 and 286. The servo-sensor 446 is operable to determine the circumferential positions of the fixed knives carried by the slotter wheel assemblies, whereas the servo-sensor 448 is employed to determine the circumferential position of the adjustable knives carried by the slotter wheel assemblies.

Adjustment of the circumferential positions of the fixed and adjustable knives carried by the slotter wheel assemblies is accomplished by respective compensator assemblies 292, 294 operatively coupled with the shafts 286 and 288. Referring specifically to FIG. 2, it will be observed that the end of shaft 288 supported by sidewall 68 extends outwardly through an appropriate opening 450 to present an extension 451, and is rotatably supported by means of a bearing assembly 452, the latter being carried by plate 454. A gear 456 is keyed to extension 451 adjacent plate 454. The input compensator 128 is mounted for rotation about extension 451, and for this purpose appropriate annular bearings 458 are provided. A tubular barrel connector 460 is secured to and rotates with gear 128 as shown. The outer end of connector 460 is in turn coupled with a reducer 462. The compensator mechanism further includes an input shaft 464, stationary support 466, index ring 468 and slip ring assembly 470. The output of the compensator assembly is conveyed through output shaft 472, the latter being connected via coupler 474 with extension 451 of shaft 288. A compensator motor 476 is coupled to input shaft 464 in the usual fashion.

The compensator mechanism 292 is in most respects identical with mechanism 294. In this case, the shaft 286 includes extension 478 which extends through an opening 480 in sidewall 68 and is supported by bearing 482 carried by plate 484. The compensator input gear 486 is mounted for rotation about extension 478, and is supported on annular bearings 488. The remainder of the mechanism 292 is identical with that of the mechanism 294, and therefore will not be described further; moreover, the same reference numerals have been applied but with the addition of the suffix "a".

Referring specifically to FIGS. 1 and 2, it will be seen that the gear 124 situated between the mechanisms 292, 294 is mounted for rotation upon stub shaft 490 affixed to wall 68 and extending through plates 454, 484. In addition, a transfer gear 492 is mounted on shaft 490 inboard of the gear 124. The gear 492 is in meshed engagement with the gears 456, 486, whereas gear 124 is in mesh only with input gear 128. Accordingly, rotation of gear 112 serves to rotate gears 122, 124; the latter drives gear 128 which in turn rotates the compensator assembly 294 and shaft 288 during normal operation thereof; output from the compensator assembly 294 is transferred via gear 492 to compensator input gear 486, which in turn drives the compensator mechanism 292 and shaft 286.

Operation

It will first be assumed that the apparatus of the invention is properly adjusted and timed for the production of finished box blanks in accordance with Fig. 22.

In this orientation, a stack of sheets 30 are placed on vacuum table 76 between the upright guides 280, 282 and in abutment with stops 104, 106 and guides 192. The pusher element 170 is free to reciprocate, and backstop 178 is fixed, i.e, the pins 206 are in their retracted position of FIG. 9, and the clamping assemblies 214, 216 are retracted.

Figure 16:
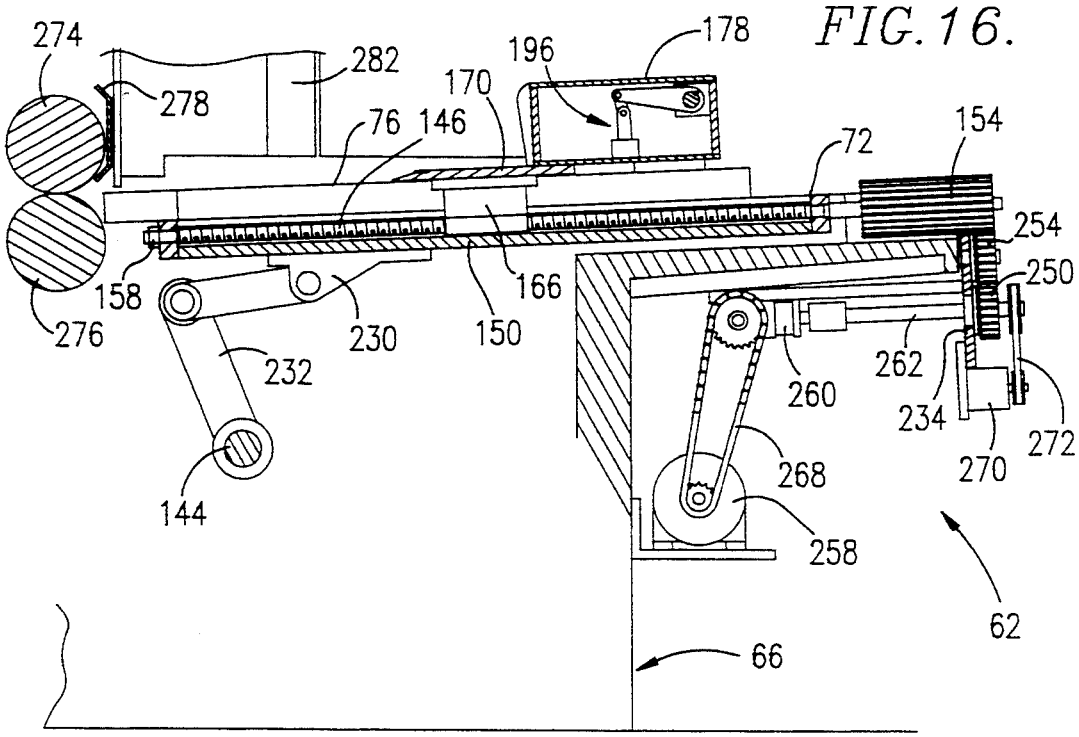
FIG. 16 is a view similar to that of FIG. 15, but showing the pusher element in its forward most position.

In order to sequentially advance the sheets 30 into the scoring and slotting assembly 64, the pusher element 170 is caused to reciprocate. This is accomplished through gear train 120 which in turn causes the feeder drive shaft 144 to reciprocate (see FIGS. 15 and 16). Such reciprocation from the FIG. 15 to the FIG. 16 position causes forward translation of the slider boxes 150, 152, thereby correspondingly translating the screws 146, 148. Inasmuch as the pusher element 170 is secured to the screws 146, 148 during normal operation, the pusher element moves forwardly to the FIG. 16 position thereof. During this movement, the bottommost sheet 30 of the stack is engaged by insert 174 and pushed into the nip between feed rollers 274, 276, whereupon it enters assembly 64 for scoring and slotting thereof. It will of course be appreciated that reverse movement of the drive shaft 144 correspondingly retracts the pusher element 170 to the FIG. 15 position, whereupon the pusher is ready to engage and feed the next succeeding sheet. During forward and reverse movement of the positioning screws 146, 148, the respective elongated gears 154, 156 remain in mesh with the associated gears 254, 256. This is assured because of the length of the gears 154, 156, and the provision of hold-down gear sets 242, 244 and 246, 248 associated with the elongated gears. The constant meshed engagement between the elongated gears 154, 156 and the underlying gear trains (see FIG. 6) assures that servo-sensor 270 continuously monitors the position of backstop 178 and pusher element 172.

As the sheet 20 is picked up by the rollers 274, 276, it is fed in sequential order through the scoring and slotting sections of the assembly 64. As the sheet passes through the scoring assemblies, the respective lower anvil rings support the sheet, while a continuous score is created by the scoring protrusions 336 on the associated scoring rings 332 This creates the score lines 38–44 on the sheet 30.

As the scored sheet proceeds through the upper and lower scoring wheel assemblies, the slots 48–58 are created therein, along with the glue flap 46. Specifically, the slots 48, 52 and 56 are created by the fixed knife blades, whereas the slots 50, 54 and 58 are created by the adjustable blades.

Rotation of the respective scoring and slotting wheel assemblies is accomplished through the drive assembly and compensators previously described. Specifically, rotation of the lower score shaft 112 effects corresponding rotation of lower slotting shaft 290, through the medium of gear 122. Rotation of the transfer gear 124 in turn causes rotation of compensator mechanisms 294 and 292, thereby rotating the upper slotting and scoring shafts 288, 286 respectively.

Finished blanks as depicted in FIG. 22 are then discharged from the output of the apparatus and are then conventionally counted and bundled for customer shipment.

After a given run is completed, it is often necessary to change the configuration of the blank-forming machine to accept sheets of a different size, and to produce scoring and slotting therein at (perhaps) different lateral positions and to differing depths on the starting sheets. This makeready operation has in the past been time-consuming and difficult to achieve, but can be readily and quickly accomplished using the apparatus of the invention. In this respect, it will be understood that the lateral positions of the scoring and slotting wheel assemblies are known via the servo-sensors 438–442, while the circumferential positions of the fixed and adjustable knives are known because of the servo-sensors 446 and 448. At the same time, a reference position (typically the retracted stopping position) of the pusher element 172 and backstop 178 is known via servo-sensor 270.

The outputs from the respective servo-sensors are directed to a central, conventional control panel for the apparatus (not shown). This control panel has input capability permitting the operator to reset the blank-forming apparatus by changing the reference position of the pusher element 170 and backstop 178, and the lateral positions of the scoring and slotting stations 296, 298, 302 and 304. Such resetting operation causes the motive adjusting mechanisms of the apparatus to quickly and precisely make the desired position changes, which are monitored and controlled by the servo-sensors.

In particular, the lateral positions of the scoring and slotting wheels of stations 296 and 298 are altered by appropriate powered rotation of the screws 390, 408, 397 and 414; similarly, such adjustment of the scoring and slotting wheels of stations 302 and 304 is effected by appropriate rotation of the screws **390*a*, 430, 396*a* and 432**.

In order to adjust the circumferential positions of the fixed knives of the slotting wheels, the compensator 294 comes into play. That is, an appropriate signal is sent to motor 476 which in turn advances or retards the position of the fixed knives by appropriate rotation of the extension 451 and thereby shaft 288. Moreover, by virtue of the interengagement of gears 456, 492 and 486, the shaft 288 is simultaneously and correspondingly advanced or retarded. Such simultaneous movement is essential, given the presence of transfer gears 384, and the split gear train drive between the compensators 292, 294 accomplishes this purpose.

Circumferential adjustment of the adjustable knives of the slotting heads is made through the medium of compensator 292. In this case, the appropriate electrical signal is sent to motor **476*a* which in turn advances or retards extension 478 and thereby shaft 286. In this case, the shaft 286 is advanced or retarded while the shaft 288 remains stationary, which again is accomplished through the split gear train drive. Inasmuch as the respective slotting heads carried by shaft 286 are coupled via the individual transfer gears to the corresponding, juxtaposed ring gears 352 of the associated slotting heads, it will be appreciated that rotation of the shaft 286 effects corresponding rotation of the ring gears 352** and thereby the adjustable knives coupled thereto, relative to the fixed knives.

Although the compensators 292, 294 would normally be operated when the scoring and slotting assembly 64 is not running, those skilled in the art will appreciate that both gross and fine adjustments of the knife positions can be made during full speed running.

Adjustment of the feeder assembly 62 is also a simple matter which can be accomplished from the control panel. In particular, when it is desired to alter the position of backstop 178 and the retracted position of pusher element 170, it is only necessary to assure that the latter is in its retracted position illustrated in FIG. 9. In this orientation, the locking pins 206, 208 are retracted, and the clamp assemblies 214, 216 are operating to clamp the backstop 178 to the mounting blocks 179 (see FIGS. 8 and 9). Thereupon, the piston and cylinder assembly 226 is actuated to extend the piston rod thereof and pivot shaft 198. This causes the pins 206, 208 to extend downwardly through the aligned apertures 194, 176 (FIG. 11), thereby locking the backstop 178 and pusher element 170 together. This pivoting also causes the assemblies 214, 216 to release backstop 178. In particular, the shafts 218, 220 are moved downwardly until the clamping heads 222, 224 move out of clamping engagement with the defining walls of the slots 78, 80 (Fig. 10)

.

In the next adjustment step, the positioning screws 146, 148 are caused to rotate in a direction for advancing or retracting the now locked-together backstop 178 and pusher element 170. Rotation of the screws 146, 150 is accomplished by appropriate energization of motor 258 which acts through chain 268, gear box 260, shafts 262 and 264 and the respective gear trains associated with each elongated gear 238, 240. Rotation of these elongated gears in turn advances or retracts the standoffs 166, 168 along the lengths of the positioning screws 146, 148, which in turn adjusts the positions of the backstop and pusher element. When this adjustment is completed, the piston and cylinder assembly 226 is again actuated to retract the piston rod thereof, thereby pivoting the shaft 198 upwardly. This retracts the pins 206, 208 to the Fig. 9 position, and moreover, locks backstop 178 in place through the medium of clamping assemblies 214, 216 (Fig. 8).

Although the makeready adjustments have been described as occurring in a sequential order, those skilled in the art will appreciate that the various adjustments can occur on a simultaneous or near-simultaneous basis. This further enhances the ability of the apparatus to be quickly adjusted.

In addition, although the makeready operation can be controlled from the described input panel, if desired, the motive adjusting mechanisms can be controlled by an appropriately programmed personal computer. This would be particularly advantageous in those instances where the processor is confronted with repeat orders; the necessary data for setting up the machine for a particular repeat order can therefore be stored in the computer memory for future use.

A particular advantage of the described apparatus is that existing box blank processing equipment can be readily retrofitted to include the improved adjustability characteristics hereof. Indeed, such retrofitting can be accomplished at a cost far less than that which would be incurred for a wholly new blank-forming device.

What is claimed is:

1. Apparatus for feeding successive sheets from a stack thereof into the input end of a blank-forming device in timed relationship with the operating components of the device, and for rapid changeover and makeready of the feeding apparatus in order to handle sheets of varying dimensions, said feeding apparatus comprising:

a shiftable pusher element; and means mounting said pusher element proximal to said input end of said device for selective reciprocal movement thereof between a retracted position and a forwardmost feeding position, and for adjusting the locations of said positions of the pusher element, said pusher element being operable during movement thereof between said retracted and forwardmost positions to engage the lowermost sheet of said stack and push the engaged sheet into the input end of said device, said mounting means including an elongated, threaded, axially rotatable, fore and aft extending screw;

an elongated gear operably coupled and in axial alignment with said screw;

means operably coupled with said screw for selective fore and aft translatory movement thereof;

means operably coupling said pusher element and screw for maintaining the position of the pusher element on the screw during said fore and aft translatory movement of the screw, and for effecting relative movement of the pusher element on the screw during axial rotation of the screw; and drive means operably coupled with said screw for selective axial rotation thereof, said drive means including a drive gear having an outer surface operably engaging said elongated gear for selective rotation thereof and said screw, said elongated gear being slidable relative to said drive gear during said fore and aft translatory movement of said screw, said drive gear having a thickness substantially less than the length of said elongated gear whereby the elongated and driving gears remain in operative engagement during said fore and aft translatory movement of said screw.

2. The apparatus as set forth in claim 1, including motive means drivingly connected with said drive gear in order to effect said axial rotation of said screw.

3. The apparatus as set forth in claim 1, said means for selective fore and aft shifting movement of said screw comprising linkage arm means operably coupled with said screw, and motive means connected with said linkage arm means.

4. The apparatus as set forth in claim 1, including an elongated, fore and aft extending, generally U-shaped slider receiving said screw, said linkage arm means being connected with said slider.

* * * * *